US006739019B2

(12) United States Patent
Schnelle et al.

(10) Patent No.: US 6,739,019 B2
(45) Date of Patent: May 25, 2004

(54) MOUNTING PLATE FOR FASTENING A FURNITURE FITTING, SUCH AS AN ARM OF A HINGE FOR A PIECE OF FURNITURE

(75) Inventors: Manfred Schnelle, Kirchlengern (DE); Ulrich Beneke, Bünde (DE)

(73) Assignee: Hettich-ONI GmbH & Co. KG, Vlotho-Exter (DE)

( * ) Notice: Subject to any disclaimer, the term of this patent is extended or adjusted under 35 U.S.C. 154(b) by 0 days.

(21) Appl. No.: 10/114,911

(22) Filed: Apr. 3, 2002

(65) Prior Publication Data

US 2002/0138944 A1 Oct. 3, 2002

(30) Foreign Application Priority Data

Apr. 3, 2001 (DE) ..... 201 05 841 U

(51) Int. Cl.[7] ..... E05D 7/04

(52) U.S. Cl. ..... 16/235; 16/242; 16/246; 16/382

(58) Field of Search ..... 16/235–238, 242, 16/246, 245, 382

(56) References Cited

U.S. PATENT DOCUMENTS 4,367,566 A * 1/1983 Rock et al. ..... 16/236
4,674,150 A * 6/1987 Salice ..... 16/382
4,718,143 A * 1/1988 Lautenschlager, Jr. ..... 16/238
4,800,625 A * 1/1989 Salice ..... 16/382
4,847,947 A * 7/1989 Tsong-Chi ..... 16/238
4,862,556 A * 9/1989 Grass ..... 16/382
4,982,476 A * 1/1991 Salice ..... 16/382
5,511,287 A * 4/1996 Lautenschlager et al. ..... 16/239
5,966,779 A * 10/1999 Salice ..... 16/382
6,203,231 B1 * 3/2001 Salice ..... 403/12

FOREIGN PATENT DOCUMENTS

DE 3543121 A1 * 6/1987

* cited by examiner

*Primary Examiner*—Chuck Y. Mah
(74) *Attorney, Agent, or Firm*—Henry M. Feiereisen

(57) ABSTRACT

A mounting plate for attachment of a furniture fitting such as a hinge arm of a furniture hinge to a wall of a piece of furniture, includes a bottom plate having an end face intended for securement to an attachment surface of the wall; and a top plate configured for placement over the bottom plate and having throughholes for passage of screw fasteners and an adjustment member which is provided to allow displacement of the top plate relative to the bottom plate. The top plate has a central portion, which is in line with the end face of the bottom plate on the attachment surface, and a marginal area which is slightly set back relative to the attachment surface.

5 Claims, 3 Drawing Sheets

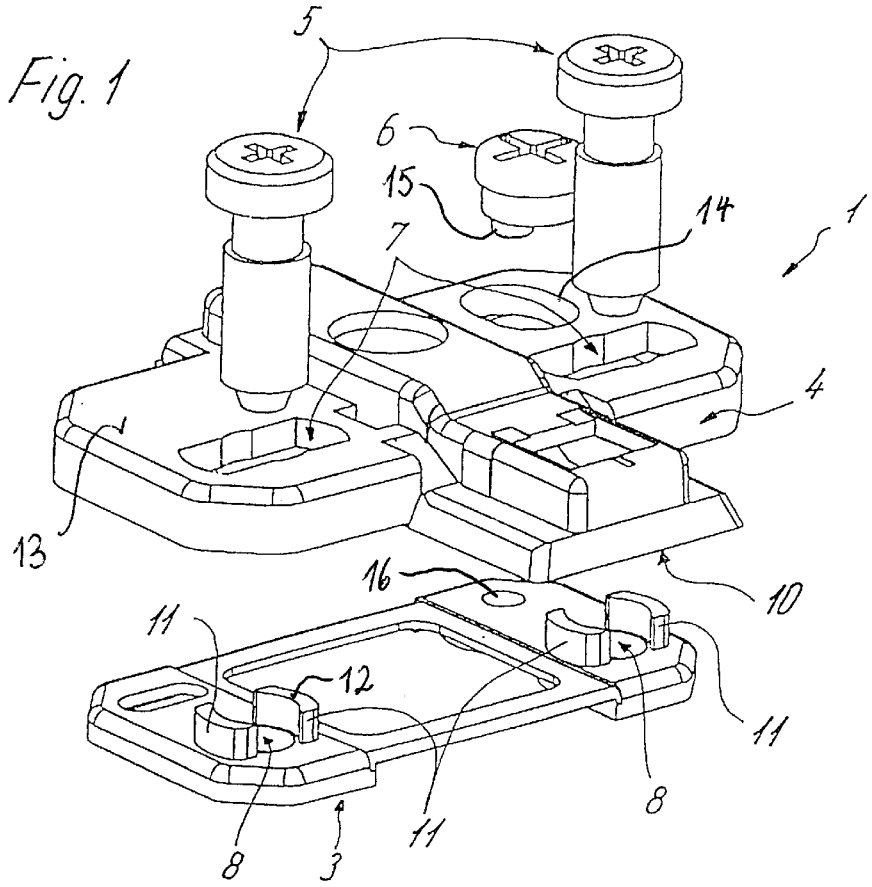
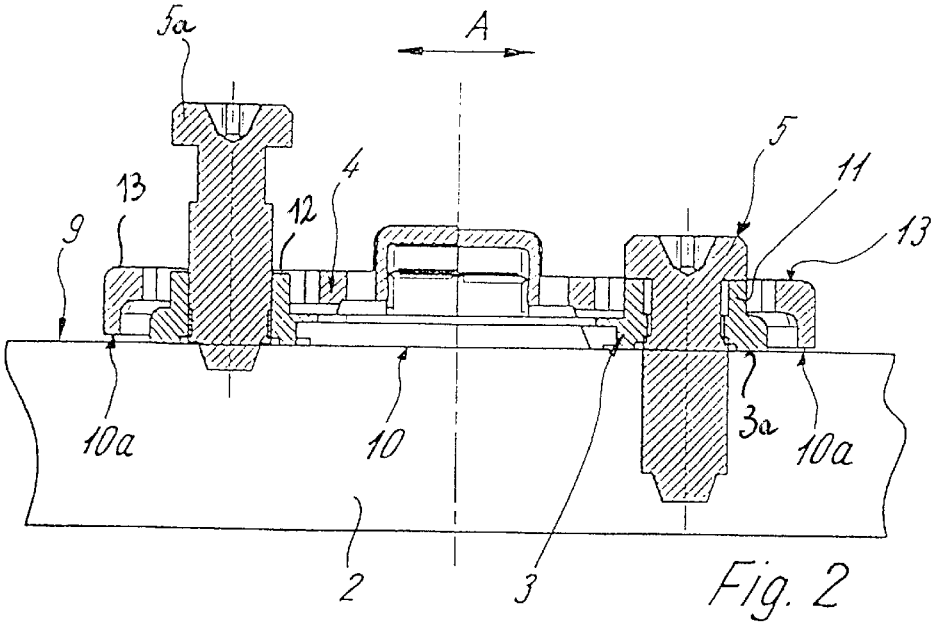
Fig. 2

Fig. 3
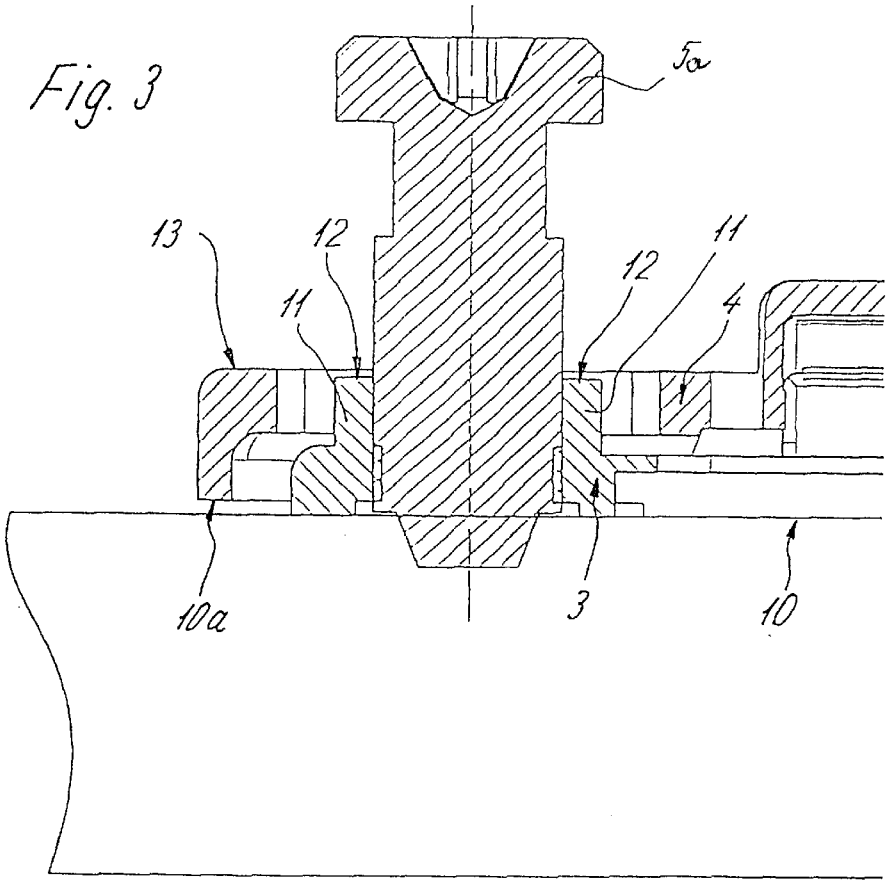
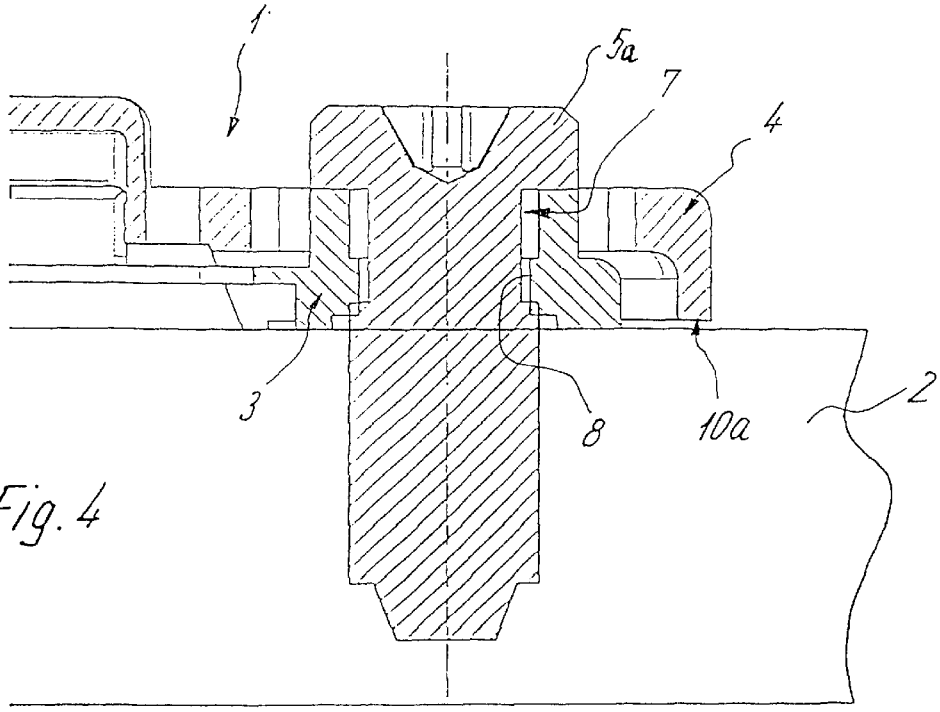
Fig. 4

MOUNTING PLATE FOR FASTENING A FURNITURE FITTING, SUCH AS AN ARM OF A HINGE FOR A PIECE OF FURNITURE

CROSS-REFERENCES TO RELATED APPLICATIONS

This application claims the priority of German Patent Application Serial No. 201 05 841.3, filed Apr. 3, 2001, pursuant to 35 U.S.C. 119(a)–(d), the subject matter of which is incorporated herein by reference.

BACKGROUND OF THE INVENTION

The present invention relates, in general, to a mounting plate for securement of a furniture fitting, such as a hinge arm to a wall of a piece of furniture.

Typically, a mounting plate involved here includes a stationary bottom plate for attachment to the wall of the piece of furniture and a top plate, which is intended for covering the bottom plate and is provided with throughholes for passage of screw fasteners and an adjustment member by which the top plate can be shifted relative to the stationary bottom plate, when the bottom and top plates are mounted to one another.

Conventional mounting plates are endowed with drawbacks and shortcomings because the top plate rests so firmly against the wall of the piece of furniture that a displacement of the top plate relative to the bottom plate through actuation of the adjustment member is no longer possible, so that a certain loosening is necessary in order to enable a displacement of the top plate and thus an adjustment. Loosening of the securement is, however, risky because it may lead to an uncontrolled shift so that the adjustment depends essentially on the skill of the operator.

It would therefore be desirable and advantageous to provide an improved mounting plate which obviates prior art shortcomings and which enables a secure attachment of the top plate relative to a wall of a piece of furniture while still allowing a displacement thereof with the aid of the adjustment member.

SUMMARY OF THE INVENTION

According to one aspect of the present invention, a mounting plate for attachment of a furniture fitting such as a hinge arm of a furniture hinge to a wall of a piece of furniture, includes a stationary bottom plate having an end face intended for securement to an attachment surface of the wall; and a top plate configured for placement over the bottom plate and having throughholes for passage of screw fasteners and a throughhole for an adjustment member which is provided to allow displacement of the top plate relative to the bottom plate in a direction of displacement, wherein, as viewed in the direction of displacement, the top plate has a central portion, which is in line with the end face of the bottom plate on the attachment surface, and a marginal area which is slightly set back relative to the attachment surface.

The present invention resolves prior art problems by the configuration of the top plate in this simple way to attain a secure attachment of the top pate to the wall, while still permitting a displacement relative to the bottom plate in opposition to friction forces which are now small enough so as to allow an intended displacement and thus adjustment of the top plate.

According to another feature of the present invention, the top plate has an outer surface which is distal to the abutment surface, wherein the bottom plate may be formed with projecting skirts, which are situated in the area of the throughholes for the screw fasteners and have end faces extending in line with the outer surface of the top plate. In this way, excessive tightening of the top plate with respect to the wall of the piece of furniture is prevented.

According to another feature of the present invention, each screw fastener has a head portion and a pin-like portion which rests upon the bottom plate, when the head portion bears on the outer surface of the top plate. As an alternative or in addition, a washer may be placed between the top plate and the head portion of the screw fastener to compensate a spacing between the bottom plate and the outer surface of the top plate.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is an exploded perspective illustration of a mounting plate according to the present invention;

FIG. 2 is a longitudinal section of the mounting plate of FIG. 1, showing on the left hand side the state prior to the attachment of the mounting plate, and on the right hand side the state after securement of the mounting plate;

FIG. 3 is a sectional view, on an enlarged scale, of the left hand side of the mounting plate of FIG. 2;

FIG. 4 is a sectional view, on an enlarged scale, of the right hand side of the mounting plate of FIG. 2;

DETAILED DESCRIPTION OF PREFERRED EMBODIMENTS

Figure 6:
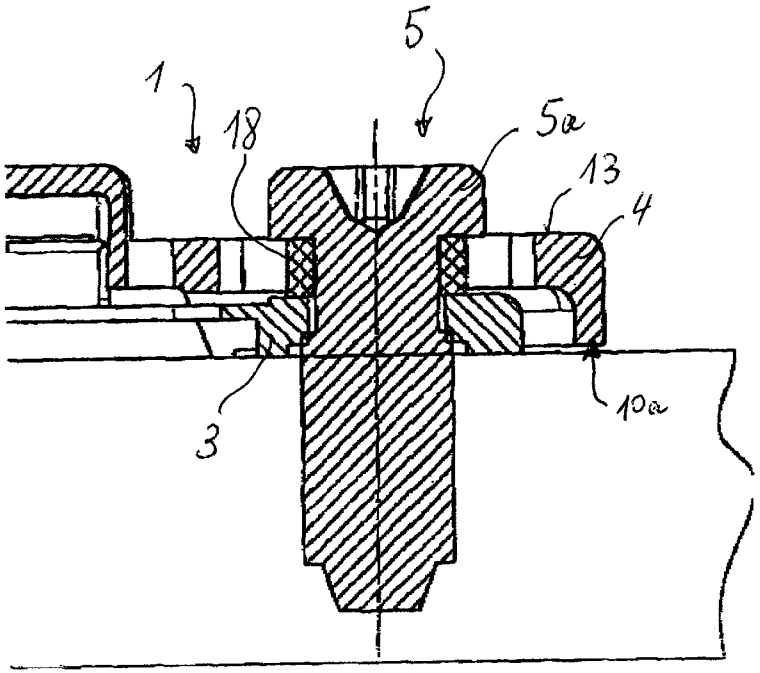
FIG. 6 is a sectional view, on an enlarged scale, o a modified mounting plate according to the present invention.

Throughout all the Figures, same or corresponding elements are generally indicated by same reference numerals.

Turning now to the drawing, and in particular to FIG. 1, there is shown an exploded perspective illustration of a mounting plate according to the present invention, generally designated by reference numeral 1 for securement of a hinge arm of a hinge to a wall 2 of a piece of furniture. The mounting plate I includes essentially a bottom plate 3, which is intended for securement to an attachment surface 9 of the wall 2, and a top plate 4, which is configured for covering the bottom plate 3. The top plate 4 is formed with elongate throughholes 7 and the bottom plate 3 is formed with throughholes 8 in alignment with the throughholes 7 for insertion of screw fasteners 5, shown here only schematically. An adjustment member 6 is provided for implementing a displacement of the top plate 4 relative to the bottom plate 3 in a displacement direction indicated by double arrow A (FIG. 2). The adjustment member 6 is hereby received in an oblong throughhole 14 of the top plate 4 and has an eccentric bearing pin 15 configured for projection in an opening 16 of the bottom plate 3. Through application of a suitable tool into a slotted head portion, the adjustment member 6 can be operated to move the top plate 4 relative to the bottom plate 3. When the bottom plate 3 is mounted to the wall 2 of the piece of furniture, as shown in the right hand side of FIG. 2, the bottom plate 3 can then be considered stationary.

The top plate 4 has an underside, which confronts the attachment surface 9 and includes, as viewed in displacement direction A, a central portion 10 which, when the top plate 4 is mounted over the bottom plate 3, extends in line with an underside 3*a* of the bottom plate 3 upon the attachment surface 9, and a marginal region 10*a* which is slightly set back with respect to the attachment surface 9, as shown in particular in FIGS. 3 and 4. Thus, the underside of the top plate 4 does not completely rest against the attachment surface 9, when mounted to the bottom plate 3 but only in the central portion 10. As a consequence, mobility of the top plate 4 relative to the bottom plate 3 is ensured, without risk that the top plate 4, to which the, not shown, hinge arm and further fittings of a piece of furniture is connected, is inadvertently shifted by the weight load relative to the bottom plate 3.

Figure 5:
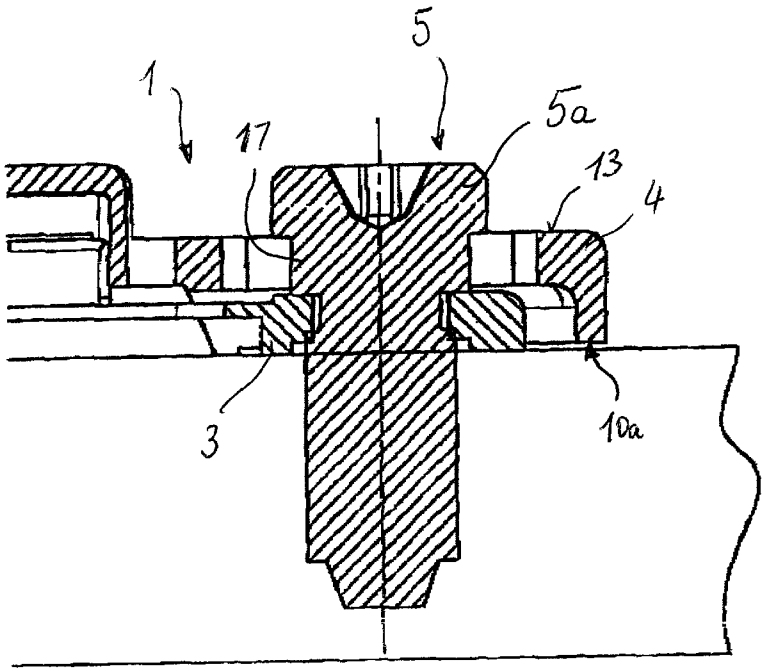
FIG. 5 is a sectional view, on an enlarged scale, of a modified screw fastener for use in a mounting plate according to the present invention.

In order to prevent excessive tightening of the top plate 3 with respect to the attachment surface 9, the bottom part 3 is formed with projecting skirts 11 in the area of the throughholes 8 for the screw fasteners 5. The skirts 11 have an end face 12 which is in line with an outer upper surface 13 of the top plate 4. As an alternative, as shown in FIG. 5, the screw fasteners 5 may also be provided with a pin-like portion 17, underneath their head portion 5*a*, for abutment against the bottom plate 3, when the head portion 5*a* rests against the upper surface 13 of the top plate 4. FIG. 6 shows another variation, which involves the provision of a washer 18, between the bottom plate 3 and the head portion 5*a* of each screw fastener 5 to compensate a spacing between the bottom plate 3 and the upper surface 13 of the top plate 4.

While the invention has been illustrated and described as embodied in a mounting plate for fastening a furniture fitting, such as an arm of a hinge for a piece of furniture, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A mounting plate for attachment of a furniture fitting such as a hinge arm of a furniture hinge to a wall of a piece of furniture, comprising:

a stationary bottom plate having an end face intended for securement to an attachment surface of the wall;

a top plate configured for placement over the bottom plate and having throughholes for passage of screw fasteners for connecting the top plate to the bottom plate; and an adjustment member, which is received in a further throughhole of the top plate and includes an eccentric member for engagement in the bottom plate, to allow displacement of the top plate relative to the bottom plate by turning the adjustment member, wherein the top plate has a central portion, which is in alignment with the end face of the bottom plate on the attachment surface, when the top plate is mounted to the bottom plate, and a peripheral area which is slightly set back relative to the attachment surface.

2. The mounting plate of claim 1, wherein the top plate has an outer surface which is distal to the attachment surface, said bottom plate formed with projecting skirts, which are situated in the area of the throughholes for the screw fasteners and have end faces extending in alignment with the outer surface of the top plate.

3. The mounting plate of claim 1, wherein the top plate has an upper surface which is distal to the attachment surface, each said screw fastener having a head portion and a pin-like portion which rests upon the bottom plate, when the head portion bears on the upper surface of the top plate.

4. The mounting plate of claim 1, wherein the top plate has an outer surface, which is distal to the attachment surface, and further comprising a washer placed between the top plate and the head portion of the screw fastener to compensate a spacing between the bottom plate and the outer surface of the top plate.

5. The mounting plate of claim 1, wherein the top plate has two of said throughholes for passage of two of said screw fasteners.

* * * * *